US010293611B2

(12) United States Patent
Ogawa

(10) Patent No.: US 10,293,611 B2
(45) Date of Patent: May 21, 2019

(54) POWER TRANSMITTER, POWER DEVICE, AND LIQUID EJECTION APPARATUS

(71) Applicant: BROTHER KOGYO KABUSHIKI KAISHA, Nagoya-shi, Aichi-ken (JP)

(72) Inventor: Mikio Ogawa, Nagoya (JP)

(73) Assignee: BROTHER KOGYO KABUSHIKI KAISHA, Nagoya-shi, Aichi-Ken (JP)

( * ) Notice: Subject to any disclaimer, the term of this patent is extended or adjusted under 35 U.S.C. 154(b) by 0 days.

(21) Appl. No.: 15/689,478

(22) Filed: Aug. 29, 2017

(65) Prior Publication Data

US 2018/0147850 A1 May 31, 2018

(30) Foreign Application Priority Data

Nov. 30, 2016 (JP) ..... 2016-232794

(51) Int. Cl.
*B41J 2/16* (2006.01)
*B41J 2/165* (2006.01)
*B41J 29/38* (2006.01)

(52) U.S. Cl.
CPC ..... *B41J 2/16544* (2013.01); *B41J 2/16517* (2013.01); *B41J 2/16538* (2013.01); *B41J 29/38* (2013.01); *B41J 2/16505* (2013.01)

(58) Field of Classification Search
None
See application file for complete search history.

(56) References Cited

U.S. PATENT DOCUMENTS

2003/0007031 A1 1/2003 Sugiyama
2007/0085875 A1* 4/2007 Shimazaki ..... B41J 2/16511 347/32
2013/0016158 A1 1/2013 Ikeda
2016/0288508 A1 10/2016 Kuno

FOREIGN PATENT DOCUMENTS

JP 2003-19807 A 1/2003
JP 2004-76472 A 3/2004
JP 2013-18172 A 1/2013
JP 2016-190348 A 11/2016

* cited by examiner

*Primary Examiner* — Erica S Lin
(74) *Attorney, Agent, or Firm* — Merchant & Gould P.C.

(57) ABSTRACT

A power transmitter is configured to transmit power from a drive source to a driven member. The power transmitter includes: a cam connected to the drive source and having a cam surface; a cam follower connected to the driven member and including a sliding portion slidable on the cam surface; and a cover configured to cover the cam surface. The cover is configured to move together with the cam follower when the sliding portion of the cam follower slides on the cam surface of the cam driven by the drive source.

12 Claims, 8 Drawing Sheets

POWER TRANSMITTER, POWER DEVICE, AND LIQUID EJECTION APPARATUS

CROSS REFERENCE TO RELATED APPLICATION

The present application claims priority from Japanese Patent Application No. 2016-232794, which was filed on Nov. 30, 2016, the disclosure of which is herein incorporated by reference in its entirety.

BACKGROUND

The following disclosure relates to a power transmitter configured to transmit power from a drive source to a driven member, and to a power device and a liquid ejection apparatus each including the power transmitter.

There is known a power transmitter configured to transmit power to a wiper for wiping a nozzle surface of an ink-jet head. This apparatus includes a cam and a cam follower for pushing up a wiper holder for holding the wiper. The cam has a cam surface having an inclined surface. When the cam is driven, a sliding portion of the cam follower is slid on the cam surface. During sliding of the sliding portion on the inclined surface, the cam follower moves in a direction intersecting the inclined surface to push the wiper holder upward.

SUMMARY

Here, foreign substances such as dust or sand in some cases enter an area between the sliding portion and the cam surface in the above-described power transmitter. If foreign substances enter into the area between the sliding portion and the cam surface, when the sliding portion and the cam surface are slid on each other, the foreign substances caught between the sliding portion and the cam surface may interfere with their sliding. When the sliding portion is slid on the inclined surface, in particular, a heavy load is imposed on a drive source for driving the cam. Thus, if foreign substances are caught between the sliding portion and the cam surface, their sliding is easily hindered.

Accordingly, an aspect of the disclosure relates to a power transmitter, a power device, and a liquid ejection apparatus in which sliding of a cam and a cam follower is not hindered by foreign substances caught between a sliding portion and a cam surface.

In one aspect of the disclosure, a power transmitter is configured to transmit power from a drive source to a driven member. The power transmitter includes: a cam connected to the drive source and having a cam surface; a cam follower connected to the driven member and including a sliding portion slidable on the cam surface; and a cover configured to cover the cam surface. The cover is configured to move together with the cam follower when the sliding portion of the cam follower slides on the cam surface of the cam driven by the drive source.

In another aspect of the disclosure, a power device includes: a drive source; a driven member; and a power transmitter configured to transmit power from the drive source to the driven member. The power transmitter includes: a cam connected to the drive source and having a cam surface; a cam follower connected to the driven member and including a sliding portion slidable on the cam surface; and a cover configured to cover the cam surface. The cover is configured to move together with the cam follower when the sliding portion of the cam follower slides on the cam surface of the cam driven by the drive source.

In still another aspect of the disclosure, a liquid ejection apparatus includes: a liquid ejection head having a nozzle surface having a plurality of nozzles; a wiper configured to wipe liquid off the nozzle surface; and a wiper mover configured to move the wiper in an intersecting direction intersecting the nozzle surface. The wiper mover includes: a drive source; and a power transmitter configured to transmit power from the drive source to the wiper. The power transmitter includes: a cam connected to the drive source and having a cam surface; a cam follower connected to the wiper, including a sliding portion slidable on the cam surface, and movable in the intersecting direction when the sliding portion slides on the cam surface; and a cover configured to cover the cam surface. The cover is configured to move together with the cam follower when the sliding portion slides on the cam surface of the cam driven by the drive source.

In still another aspect of the disclosure, a liquid ejection apparatus includes: a liquid ejection head having a nozzle surface having a plurality of nozzles; a cap configured to cover the plurality of nozzles; and a cap mover configured to move the cap in an intersecting direction intersecting the nozzle surface. The cap mover includes: a drive source; and a power transmitter configured to transmit power from the drive source to the cap. The power transmitter includes: a cam connected to the drive source and having a cam surface; a cam follower connected to the cap, including a sliding portion slidable on the cam surface, and movable in the intersecting direction when the sliding portion slides on the cam surface; and a cover configured to cover the cam surface. The cover is configured to move together with the cam follower when the sliding portion slides on the cam surface of the cam driven by the drive source.

In still another aspect of the disclosure, a liquid ejection apparatus includes: a liquid ejection head having a nozzle surface having a plurality of nozzles; a carriage supporting the liquid ejection head and movable in a scanning direction parallel with the nozzle surface; a cap configured to cover the plurality of nozzles; a carriage lock configured to lock the carriage from moving in the scanning direction when the plurality of nozzles are covered with the cap; and a lock mover configured to move the carriage lock in an intersecting direction intersecting the nozzle surface. The lock mover includes: a drive source; and a power transmitter configured to transmit power from the drive source to the carriage lock. The power transmitter includes: a cam connected to the drive source and having a cam surface; a cam follower connected to the carriage lock, including a sliding portion slidable on the cam surface, and movable in the intersecting direction when the sliding portion slides on the cam surface; and a cover configured to cover the cam surface. The cover is configured to move together with the cam follower when the sliding portion slides on the cam surface of the cam driven by the drive source.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which:

FIGS. 2A through 2C are views for explaining upward and downward movement of a cap and a carriage lock, wherein FIG. 2A illustrates a state in which the cap and the carriage lock are located at their respective lowermost positions, FIG. 2B illustrates a state in which the cap and the carriage lock are located at their respective middle positions in the up and down movement, and FIG. 2C illustrates a state in which the cap and a carriage are located at their respective uppermost positions;

FIGS. 4A through 4C are views of components including the wiper when the components are viewed from a left side in a scanning direction, wherein FIG. 4A illustrates a state in which the wiper is located at its lowermost position, FIG. 4B illustrates a state in which the wiper is being moved upward, and FIG. 4C illustrates a state in which the wiper is located at its uppermost position;

DETAILED DESCRIPTION OF THE EMBODIMENT

Hereinafter, there will be described one embodiment by reference to the drawings.

Overall Configuration of Printer

Figure 1:
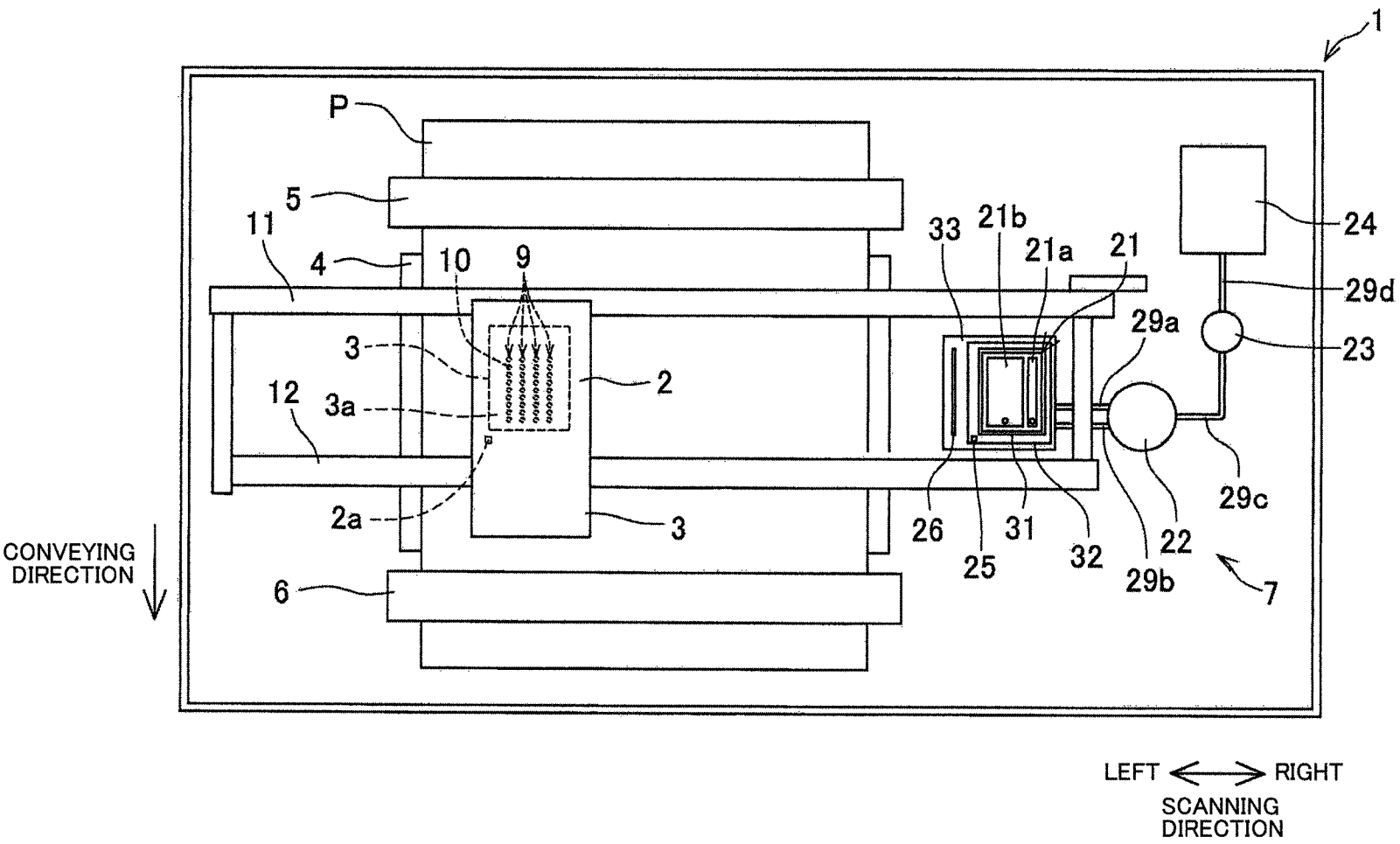
FIG. 1 is a schematic view of a printer according to one embodiment.

FIG. 1 illustrates a printer 1 according to one embodiment. This printer 1 is one example of a liquid ejection apparatus and includes a carriage 2, an ink-jet head 3 as one example of a liquid ejection head, a platen 4, conveying rollers 5, 6, and a maintenance unit 7.

The carriage 2 is supported by guide rails 11, 12 extending in a scanning direction. The carriage 2 is connected to a carriage motor 106 (see FIG. 7) via, e.g., a belt (not illustrated). The carriage 2 may be moved in the scanning direction by driving the carriage motor 106. It is noted that right and left sides in the scanning direction are defined as illustrated in FIG. 1, and the following description will be provided using these right and left sides.

The ink-jet head 3 is mounted on the carriage 2. The ink-jet head 3 has a lower surface as a nozzle surface 3*a* in which a multiplicity of nozzles 10 are formed. The ink-jet head 3 has four nozzle rows 9 arranged in the scanning direction. Each of the nozzle rows 9 is formed by the nozzles 10 arranged in a conveying direction orthogonal to the scanning direction. Ink of one color is ejected from the nozzles 10 of a corresponding one of the nozzle rows 9. Specifically, black ink, yellow ink, cyan ink, and magenta ink are ejected in order from the rightmost nozzle row 9.

The platen 4 is disposed under the ink-jet head 3 so as to be opposed to the nozzle surface 3*a*. An upper surface of the platen 4 supports a recording sheet P onto which the ink is ejected from the ink-jet head 3. The conveying rollers 5, 6 are respectively disposed upstream and downstream of the carriage 2 in the conveying direction. The conveying rollers 5, 6 are driven by a conveying motor 107 (see FIG. 7) to convey the recording sheet P in the conveying direction.

The conveying rollers 5, 6 convey the recording sheet P in the conveying direction by a particular distance in one conveyance. The carriage 2 is moved in the scanning direction in each conveyance of the recording sheet P. During this movement of the carriage 2, the ink is ejected from the nozzles 10 to print an image on the recording sheet P.

Maintenance Unit

As illustrated in FIG. 1, the maintenance unit 7 is located to the right of the platen 4 in the scanning direction. The maintenance unit 7 includes a cap 21, a switching unit 22, a pump 23, a waste-liquid tank 24, a carriage lock 25, and a wiper 26.

The cap 21 is located to the right of the platen 4 in the scanning direction. The cap 21 includes two cap portions 21*a*, 21*b* arranged next to each other in the scanning direction. When the carriage 2 is moved to a maintenance position located to the right of the platen 4 in the scanning direction, the nozzles 10 forming the rightmost nozzle row 9 overlap the cap portion 21*a* in a vertical direction (as one example of an intersecting direction intersecting the nozzle surface), and the nozzles 10 forming the left three nozzle rows 9 overlap the cap portion 21*b* in the vertical direction. The cap 21 is movable upward and downward as will be described below. That is, the cap 21 is movable in the intersecting direction. When the cap 21 is moved upward in a state in which the carriage 2 is located at the maintenance position, the cap 21 is brought into close contact with the nozzle surface 3*a*, so that the nozzles 10 are covered with the cap 21. More specifically, the nozzles 10 forming the rightmost nozzle row 9 are covered with the cap portion 21*a*, and the nozzles 10 forming the left three nozzle rows 9 are covered with the cap portion 21*b*. While the nozzles 10 are covered with the cap 21 by the close contact of the cap 21 with the nozzle surface 3*a* in the present embodiment, the nozzles 10 may be covered with the cap 21 in other methods. For example, the printer 1 may be configured such that the ink-jet head 3 includes a frame disposed around the nozzle surface 3*a* to protect the nozzle surface 3*a*, and the cap 21 is brought into close contact with the frame to cover the nozzles 10 with the cap 21.

Figure 3A:
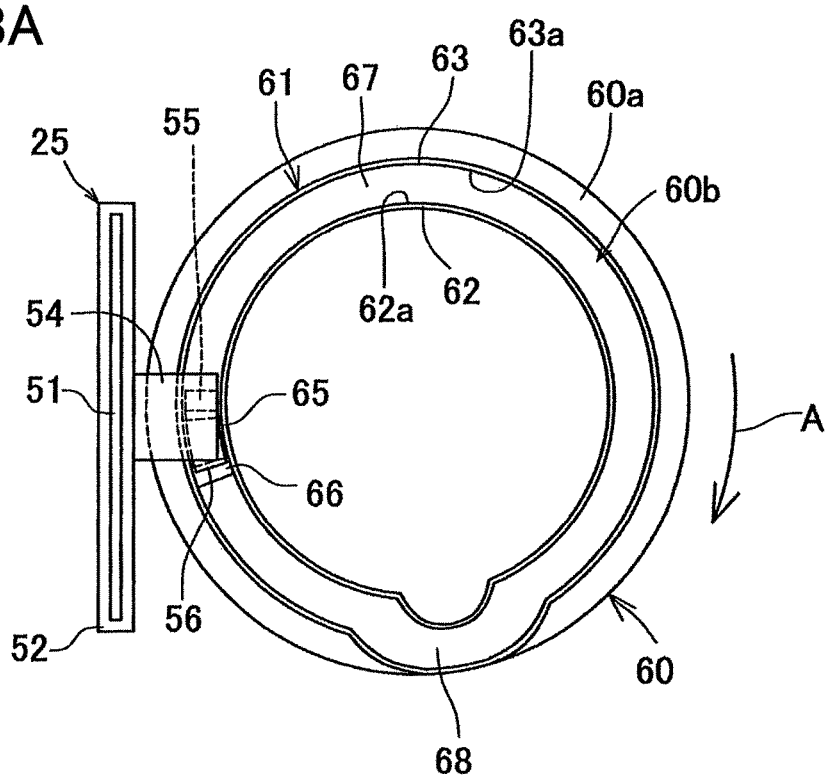
FIG. 3A is a plan view illustrating a positional relationship between a wiper and a rotating cam.
Figure 3B:
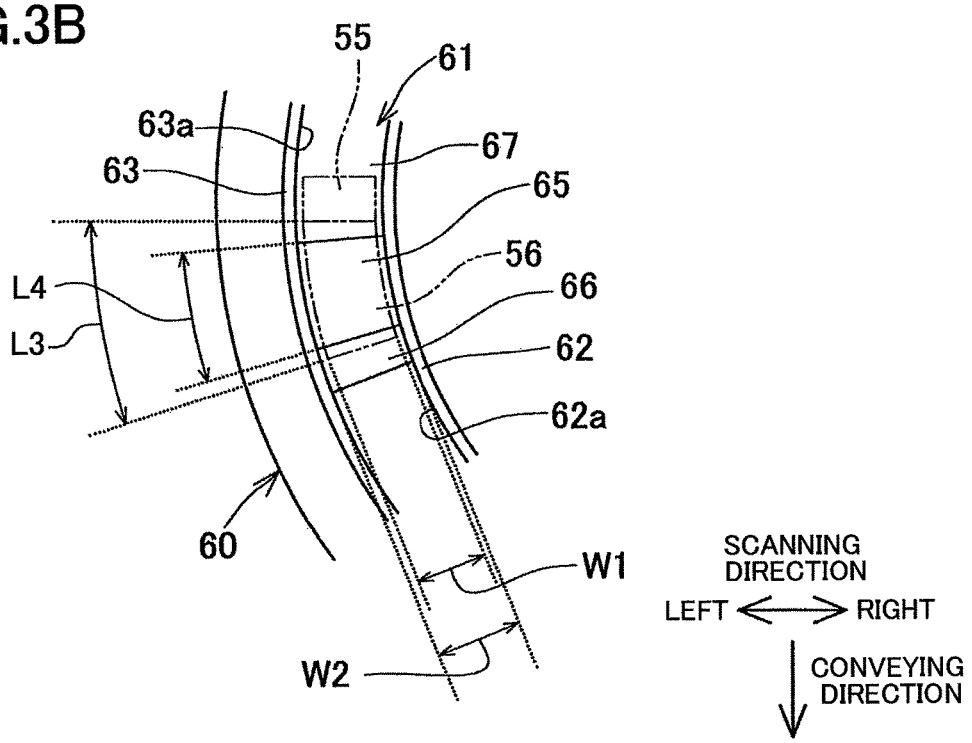
FIG. 3B is a partially enlarged view of the rotating cam.

The cap portions 21*a*, 21*b* are connected to the switching unit 22 respectively by tubes 29*a*, 29*b*. The switching unit 22 is connected to the pump 23 by a tube 29*c* and configured to selectively connect one of the cap portions 21*a*, 21*b* to the pump 23. The switching unit 22 performs this switching by rotating a switching member (not illustrated), having grooves forming ink passages, for example (see JP-A-2016-190348, for example). Here, the switching member may be coupled to a rotating cam 60 (see FIGS. 3A and 3B) which will be described below, and rotated with the rotating cam 60. In the case where this configuration is employed, the switching unit 22 is located under the cap 21 and the wiper 26, but FIG. 1 illustrates the switching unit 22 to the right of the cap 21 and the wiper 26 in the scanning direction for easy understanding.

The pump 23 is connected to the waste-liquid tank 24 by a tube 29*d*. The waste-liquid tank 24 is located on an opposite side of the pump 23 from the switching unit 22. When the pump 23 is driven in a state in which the nozzles 10 are covered with the cap 21, and the cap portion 21*a* is connected to the pump 23 by the switching unit 22, the black ink is discharged from the ink-jet head 3 through the nozzles 10 forming the rightmost nozzle row 9. This discharge may be hereinafter referred to as "suction purging for the black ink". When the pump 23 is driven in a state in which the nozzles 10 are covered with the cap 21, and the cap portion 21*b* is connected to the pump 23 by the switching unit 22, the yellow ink, the cyan ink, and the magenta ink are discharged from the ink-jet head 3 through the nozzles 10 forming the left three nozzle rows 9. This discharge may be hereinafter referred to as "suction purging for the color ink". The ink discharged from the ink-jet head 3 by the suction purging is stored in the waste-liquid tank 24.

Figure 2A:
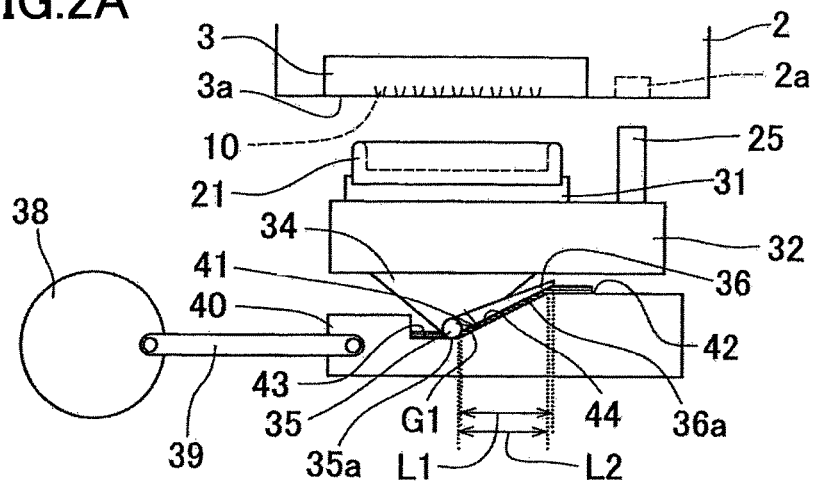
Figure 2B:
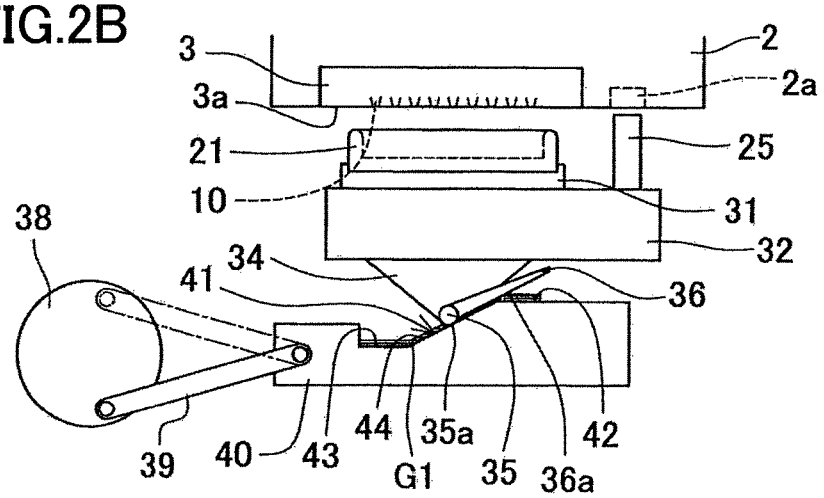
Figure 2C:
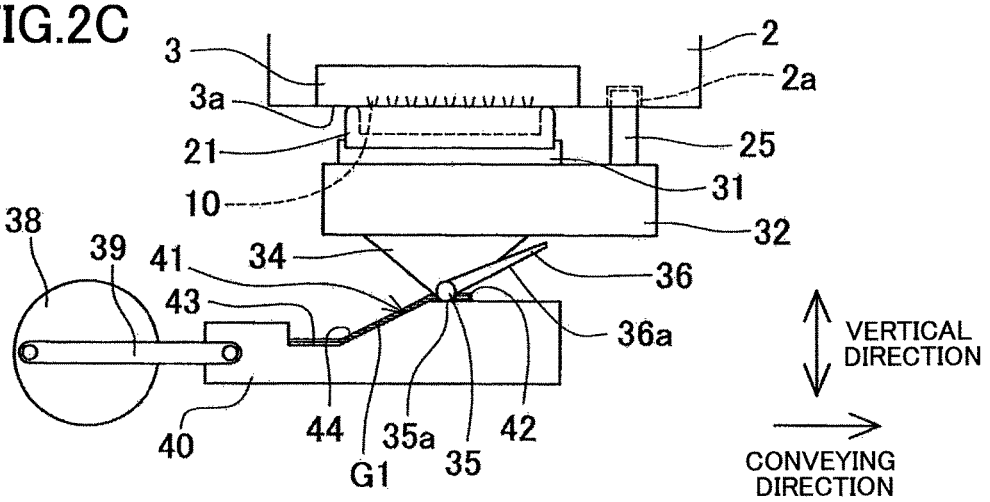

As illustrated in FIGS. 1-2C, the cap 21 is held by a cap holder 31. The cap holder 31 is supported by a supporter 32 so as to be movable on a horizontal plane. Here, there is some wobbling between the carriage 2 and each of the guide rails 11, 12. Thus, the carriage 2 is in some case rotated on the horizontal plane when an external force is applied to the carriage 2 due to, e.g., vibrations in the state in which the nozzles 10 are covered with the cap 21. In the present embodiment, the cap 21 and the cap holder 31 are rotated on the horizontal plane, following the rotation of the carriage 2, thereby preventing damages to the nozzle surface 3*a* due to a rub of the cap 21 against the nozzle surface 3*a*.

As illustrated in FIGS. 1-2C, the supporter 32 is mounted and supported on a base 33 so as to be movable upward and downward. A protrusion 34 protrudes downward from a lower surface of the supporter 32. A cam follower 35 protruding in the scanning direction is provided on a lower end portion of the protrusion 34.

A slide cam 40 is disposed under the supporter 32. An upstream end portion of the slide cam 40 in the conveying direction is connected to a crank gear 38 via a link 39. The crank gear 38 is connected to a slide-cam motor 108 via, e.g., a gear (not illustrated). When the crank gear 38 is rotated in one direction (e.g., the clockwise direction in FIG. 2) by driving the slide-cam motor 108, the slide cam 40 is reciprocated in a direction parallel with the conveying direction. While the present description is given assuming that the slide-cam motor 108 specific to the slide cam 40 is provided for easy understanding, the present disclosure is not limited to this construction. For example, another motor provided in the printer 1 may be connectable to the crank gear 38 so as to have the function of the slide-cam motor 108.

An upper surface of the slide cam 40 is a cam surface 41 that contacts a lower end 35*a* (as one example of a sliding portion) of the cam follower 35 to support the cam follower 35 from its lower side. The cam surface 41 has two parallel surfaces 42, 43 and an inclined surface 44. The parallel surface 42 is parallel with the scanning direction and the conveying direction. In other words, the parallel surface 42 is parallel with the horizontal plane. The parallel surface 43 is also parallel with the scanning direction and the conveying direction and is located below the parallel surface 42 and upstream of the parallel surface 42 in the conveying direction. The inclined surface 44 is located between the parallel surface 42 and the parallel surface 43 in the conveying direction. The inclined surface 44 is inclined with respect to the horizontal plane so as to be higher at a downstream end portion of the inclined surface 44 in the conveying direction than at an upstream end portion thereof in the conveying direction. In other words, the inclined surface 44 is inclined so as to be closer to the nozzle surface 3*a* in the vertical direction at the downstream end portion of the inclined surface 44 than at the upstream end portion thereof. The inclined surface 44 connects the parallel surface 42 and the parallel surface 43 to each other.

A cover 36 is provided on the cam follower 35 so as to correspond to the inclined surface 44. The cover 36 extends from the cam follower 35 in a direction directed toward a downstream side in the conveying direction. This direction is one example of a direction reverse to a first direction. The cover 36 may be snapped on the cam follower 35, bonded to the cam follower 35 with an adhesive, or integrally molded with the cam follower 35. A lower surface 36*a* (as one example of a facing surface) of the cover 36 is a flat surface substantially parallel with the inclined surface 44. An upstream end of the lower surface 36*a* of the cover 36 in the conveying direction (i.e., one of opposite ends of the lower surface 36*a* which is closer to the cam follower 35 than the other) is located above the lower end 35*a* of the cam follower 35. Regardless of the position of the slide cam 40, a downstream end of the lower surface 36*a* of the cover 36 in the conveying direction (i.e., one of the opposite ends of the lower surface 36*a* which is farther from the cam follower 35 than the other) is higher in position than an upper end of the inclined surface 44, i.e., a downstream end of the inclined surface 44 in the conveying direction. Thus, regardless of the position of the slide cam 40, the downstream end of the lower surface 36*a* of the cover 36 in the conveying direction is further from the lower end 35*a* of the cam follower 35 than the upper end of the inclined surface 44 in the vertical direction. The length L1 of the lower surface 36*a* of the cover 36 in the conveying direction is slightly greater than the length L2 of the inclined surface 44 in the conveying direction. More specifically, the length L1 of the lower surface 36*a* of the cover 36 is substantially equal in the conveying direction to the sum of the length L2 of the inclined surface 44 and an error of a stop position of the slide cam 40. Here, the stop position of the slide cam 40 in a state in which the cover 36 faces and covers the inclined surface 44 (the state in FIG. 2A) as will be described below is set and stored in a read-only memory (ROM) 102 (see FIG. 7) of a controller 100 which will be described below. The error of the stop position of the slide cam 40 is an error that is allowed for the set stop position and corresponds to positional displacement of the slide cam 40 in the conveying direction. This error is caused by an error of a stop position of the slide-cam motor 108 and/or a backlash between gears connecting the slide cam 40 and the slide-cam motor 108 to each other, for example. The cam surface 41 is coated with grease G1 (as one example of a lubricant).

In a state in which the cam follower 35 is located on the parallel surface 43, as illustrated in FIG. 2A, the supporter 32 is located at the lowermost position of its moving area, and the cap 21 is also located at the lowermost position of its moving area, that is, the cap 21 is furthest from the nozzle surface 3*a* in the vertical direction in this state. Also, the cover 36 faces and covers the inclined surface 44 in this state. Also, as described above, the length L1 of the lower surface 36*a* of the cover 36 in the conveying direction is slightly greater than the length L2 of the inclined surface 44 in the conveying direction and substantially equal to the sum of the length L2 of the inclined surface 44 and the error of the stop position of the slide cam 40 in the conveying direction. Accordingly, the entire length of the inclined surface 44 in the conveying direction is covered with the cover 36, thereby preventing foreign substances such as dust or sand from adhering to the inclined surface 44. Furthermore, since the length L1 of the lower surface 36*a* of the cover 36 is substantially equal in the conveying direction to the sum of the length L2 of the inclined surface 44 and the error of the stop position of the slide cam 40, the cover 36 reliably covers the entire length of the inclined surface 44 in the conveying direction without making the length L1 in the conveying direction unnecessarily long. In the present embodiment, since the cover 36 is provided on the cam follower 35, there is no space between the cam follower 35 and the cover 36, making it possible for the cover 36 to reliably cover the inclined surface 44.

Without the cover 36, since the upper surface of the slide cam 40 is the cam surface 41 facing obliquely upward, foreign substances falling from above may easily adhere to the inclined surface 44. Accordingly, covering the inclined surface 44 with the cover 36 is effective to prevent foreign substances from adhering to the inclined surface 44 as described above.

The lower surface 36*a* of the cover 36 is flat and substantially parallel with the inclined surface 44. Also, the upstream and downstream ends of the lower surface 36*a* of the cover 36 in the conveying direction are located as described above. In this state, accordingly, a gap of about 0.5 mm is formed between the cover 36 and the inclined surface 44. This space is filled with the grease G1. This construction prevents ingress of foreign substances into the space in the state in which the inclined surface 44 is covered with the cover 36.

In the present embodiment, since the cover 36 is provided on the cam follower 35, it is difficult for foreign substances to enter a space formed between the lower end 35*a* of the cam follower 35 and the parallel surface 43 from a downstream side in the conveying direction when the slide cam 40 is at rest in the state in which the lower end 35*a* of the cam follower 35 is in contact with the parallel surface 43.

When the slide cam 40 is moved in a direction directed toward an upstream side in the conveying direction (note that the direction directed toward the upstream side is one example of the first direction) in this state, as illustrated in FIGS. 2A-2C, the lower end 35*a* of the cam follower 35 is slid on the parallel surface 43, the inclined surface 44, and the parallel surface 42 in order. In this sliding, the grease G1 provided between the lower end 35*a* of the cam follower 35 and the cam surface 41 enables smooth movement of the lower end 35*a* of the cam follower 35 and the cam surface 41. When the lower end 35*a* of the cam follower 35 is slid on the inclined surface 44, the supporter 32 including the cam follower 35 and the cover 36 is moved upward, that is, the cam follower 35 and the cover 36 are moved as a unit. This movement moves the cap holder 31 and the cap 21 upward. In the case where the cap 21 is moved upward in the state in which the carriage 2 is located at the maintenance position, when the slide cam 40 is moved to a position at which the parallel surface 42 is slid on the cam follower 35, the cap 21 is located at its highest position, and the nozzles 10 are covered with the cap 21. In the present embodiment, the upward movement of the cam follower 35 is one example of movement for transmission of power to a driven member.

When the lower end 35*a* of the cam follower 35 is moved upward by sliding between the lower end 35*a* and the inclined surface 44, gravity and a frictional force between the cam follower 35 and the inclined surface 44 act on the cam follower 35. These forces act in a direction from a downstream side toward an upstream side of the inclined surface 44 in the conveying direction. When the cam follower 35 is moved upward, the cam follower 35 is moved against these forces, whereby a relatively large load is exerted on the slide-cam motor 108. Without the cover 36, foreign substances may adhere to the inclined surface 44 when the slide cam 40 is at rest in the state in which the lower end 35*a* of the cam follower 35 is in contact with the parallel surface 43, and foreign substances may thereafter enter a space between the cam follower 35 and the inclined surface 44 when the slide cam 40 is moved. If foreign substances enter the space between the cam follower 35 and the inclined surface 44, when the cam follower 35 and the inclined surface 44 are slid, the foreign substances may be caught between the cam follower 35 and the inclined surface 44 and interfere with their sliding, which may impose an excessive load on the slide-cam motor 108. In the present embodiment, in contrast, the inclined surface 44 is covered with the cover 36 in the state in which the cam follower 35 is located on the parallel surface 43 as described above. This configuration prevents foreign substances from adhering to the inclined surface 44 when the cam follower 35 is at rest on the parallel surface 43 before upward movement of the cap 21. As a result, when the lower end 35*a* of the cam follower 35 is moved upward with sliding on the inclined surface 44, this sliding is not hindered by foreign substances caught between the lower end 35*a* and the inclined surface 44, making it possible to prevent an excessive load from acting on the slide-cam motor 108.

In the present embodiment, a load imposed on the slide-cam motor 108 increases when the cam follower 35 is moved upward with sliding on the inclined surface 44, but the cover 36 provided on the cam follower 35 is shaped so as to have only a portion corresponding to the inclined surface 44 and not to have portions corresponding to the parallel surfaces 42, 43. That is, the cover 36 has a rational shape that enables the cover 36 to cover the inclined surface 44 which is highly required for covering among the cam surface 41.

Here, from the viewpoint of preventing foreign substances from adhering to the inclined surface 44, the cover 36 and the inclined surface 44 are preferably in contact with each other with no space therebetween in the state in which the inclined surface 44 is covered with the cover 36. In this case, however, when the lower end 35*a* of the cam follower 35 and the inclined surface 44 are slid, the lower surface 36*a* of the cover 36 and the inclined surface 44 are also slid, leading to a larger load on the slide-cam motor 108. In the present embodiment, in contrast, the space is formed between the cover 36 and the inclined surface 44 in the state in which the lower surface 36*a* of the cover 36 faces the inclined surface 44. This space prevents sliding of the lower surface 36*a* of the cover 36 and the inclined surface 44 when the lower end 35*a* of the cam follower 35 is slid on the inclined surface 44, resulting in reduced load on the slide-cam motor 108.

In the present embodiment, as described above, when the slide cam 40 is at rest in the state in which the lower end 35*a* of the cam follower 35 is in contact with the parallel surface 43, it is difficult for foreign substances to enter the space formed between the lower end 35*a* of the cam follower 35 and the parallel surface 43. Accordingly, it is possible for the lower end 35*a* of the cam follower 35 and the parallel surface 43 to be slid without being hindered by foreign substances caught therebetween.

When the slide cam 40 is moved toward the downstream side in the conveying direction in the state illustrated in FIG. 2C, as illustrated in FIGS. 2A-2C, the cam follower 35 is slid on the parallel surface 42, the inclined surface 44, and the parallel surface 43 in this order. When the cam follower 35 is slid on the inclined surface 44, the supporter 32 including the cam follower 35 and the cover 36 are moved downward, that is, the cam follower 35 and the cover 36 are moved as a unit. This movement moves the cap holder 31 and the cap 21 downward.

Carriage Lock

The carriage locker 25 is provided downstream of the cap 21 and the cap holder 31 of the supporter 32 in the conveying direction and extends upward from an upper surface of the supporter 32. A recess 2*a* is formed in a lower surface of the carriage 2 at its portion that overlaps the carriage lock 25 in the vertical direction in the state in which the carriage 2 is located at the maintenance position.

When the supporter 32 is moved upward and downward by moving the slide cam 40 in the conveying direction as described above, the carriage lock 25 provided on the supporter 32 is also moved upward and downward. When the cam follower 35 is located on the parallel surface 43 or a portion of the inclined surface 44 which is closer to the parallel surface 43 than a particular position on the inclined surface 44, as illustrated in FIGS. 2A and 2B, the carriage lock 25 is located below a lower end of the recess 2*a*. It is noted that the particular position is located at a position on the inclined surface 44 other than ends of the inclined surface 44 in the conveying direction. In this state, the carriage lock 25 does not overlap the carriage 2 in the scanning direction, and the carriage lock 25 does not limit movement of the carriage 2 in the scanning direction. That is, the carriage 2 is movable in the scanning direction in this state. When the cam follower 35 is located on the parallel surface 42 or a portion of the inclined surface 44 which is closer to the parallel surface 42 than the particular position, as illustrated in FIG. 2C, an upper end portion of the carriage lock 25 is inserted in the recess 2*a*. As a result, the carriage 2 and the carriage lock 25 overlap each other in the scanning direction in the state in which the nozzles 10 are covered with the cap 21, so that the carriage lock 25 limits movement of the carriage 2 in the scanning direction.

Wiper

The wiper 26 is for wiping ink off the nozzle surface 3*a*. As illustrated in FIG. 1, the wiper 26 is located between the platen 4 and the cap 21 in the scanning direction. As illustrated in FIGS. 3A-5C, the wiper 26 includes a wiper rubber 51 and a wiper holder 52. The wiper rubber 51 is formed of a material such as rubber and shaped like a thin plate. The wiper rubber 51 has a surface extending in the conveying direction and the vertical direction.

Figure 5A:
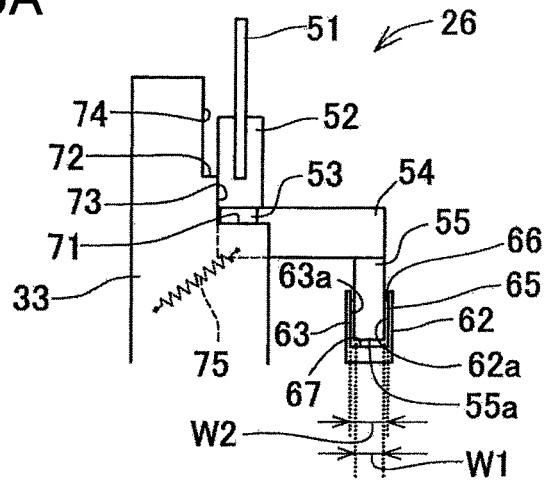
FIGS. 5A through 5C are views of the components including the wiper when the components are viewed from a downstream side in a conveying direction, wherein FIGS. 5A through 5C respectively correspond to FIGS. 4A through 4C.
Figure 5B:
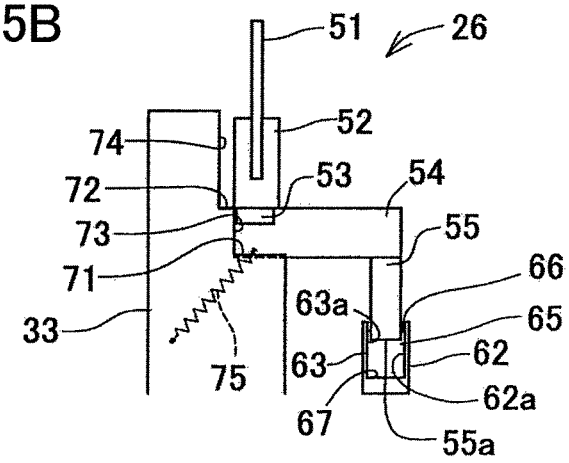
Figure 5C:
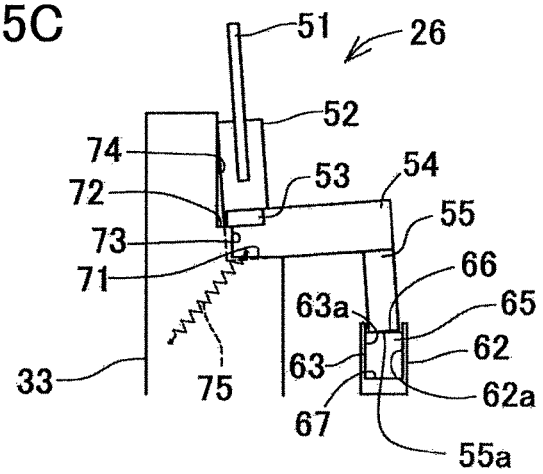
Figure 5C:
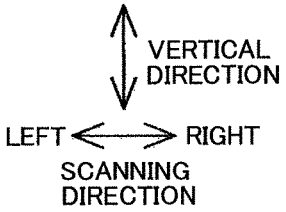

The wiper holder 52 holds a lower portion of the wiper rubber 51. Protrusions 53 are respectively provided on opposite end portions of a lower end portion of the wiper holder 52 in the conveying direction. Each of the protrusions 53 protrudes downward. The wiper holder 52 is mounted on the base 33. As illustrated in FIGS. 5A-5C, the base 33 has support surfaces 71, 72 and side wall surfaces 73, 74. Each of the support surfaces 71, 72 is a flat surface for supporting lower portions of the protrusions 53. The support surface 72 is located above the support surface 71 and to the left of the support surface 71 in the scanning direction. The side wall surface 73 extends in the vertical direction and connects a left end of the support surface 71 in the scanning direction and a right end of the support surface 72 in the scanning direction to each other. The side wall surface 74 extends in the vertical direction, and a lower end of the side wall surface 74 is connected to a left end of the support surface 72 in the scanning direction.

An arm 54 is provided on the lower end portion of the wiper holder 52 at its central portion in the conveying direction. The arm 54 extends rightward in the scanning direction. The arm 54 is connected to the base 33 via a spring 75 and pulled by the spring 75 toward a lower left side of the arm 54. A cam follower 55 protrudes downward from a right end portion of the arm 54 in the scanning direction.

The printer 1 includes the rotating cam 60 corresponding to the cam follower 55. The axial direction of the rotating cam 60 coincides with the vertical direction. As indicated by the arrow A in FIG. 3A, the rotating cam 60 is rotated by a rotating-cam motor 109 in a clockwise direction (as another example of the first direction) when viewed from above. This direction may be hereinafter referred to as "rotational direction of the rotating cam 60". While the present description is given assuming that the rotating-cam motor 109 specific to the rotating cam 60 is provided for easy understanding, the present disclosure is not limited to this construction. For example, another motor provided in the printer 1 may be connectable to the rotating cam 60 so as to have the function of the rotating-cam motor 109.

The rotating cam 60 has a groove 61. The groove 61 extends over the entire perimeter of the rotating cam 60 in the circumferential direction of the rotating cam 60. The groove 61 is defined by two side walls 62, 63 provided upright on an upper surface 60*a* of the rotating cam 60. Specifically, each of the side walls 62, 63 extends on the upper surface 60*a* of the rotating cam 60 over the entire perimeter of the rotating cam 60. The side wall 63 is located on an outer side of the side wall 62 in the radial direction of the rotating cam 60. With this construction, the groove 61 of the rotating cam 60 is defined by (i) a bottom surface 60*b* (as one example of a cam surface) that is a portion of the upper surface 60*a* which is located between the two side walls 62, 63, (ii) a side wall surface 62*a* formed by an outer surface of the side wall 62 in the radial direction of the rotating cam 60, and (iii) a side wall surface 63*a* formed by an inner surface of the side wall 63 in the radial direction of the rotating cam 60.

The bottom surface 60*b* of the groove 61 has an inclined surface 65. The inclined surface 65 is inclined with respect to the rotational direction of the rotating cam 60 so as to be higher at an upstream portion of the inclined surface 65 in the rotational direction of the rotating cam 60 than at a downstream portion of the inclined surface 65 in the rotational direction of the rotating cam 60. In other words, the inclined surface 65 is inclined so as to be closer to the nozzle surface in the intersecting direction at the upstream portion than at the downstream portion. The bottom surface 60*b* of the groove 61 has a parallel surface 66 that continues to an upstream end of the inclined surface 65 in the rotational direction of the rotating cam 60 and extends parallel with the rotational direction of the rotating cam 60. The inclined surface 65 and the parallel surface 66 are coated with grease G2 as another example of the lubricant. A portion of the bottom surface 60*b* other than the inclined surface 65 and the parallel surface 66 is a parallel surface 67 located at substantially the same height level as that of a lower end of the inclined surface 65 and extending parallel with the scanning direction and the conveying direction. The parallel surface 67 continues to a downstream end of the inclined surface 65 in the rotational direction of the rotating cam 60. The groove 61 includes a protrusion 68 located upstream of the parallel surface 66 in the rotational direction of the rotating cam 60 and protruding to a position further outward than the other portion of the groove 61 in the radial direction of the rotating cam 60.

The cam follower 55 includes a portion including a lower end 55*a* (as another example of the sliding portion) and located in the groove 61. A cover 56 is provided on the cam follower 55. The cover 56 extends from the cam follower 55 in a direction reverse to the rotational direction of the rotating cam 60 (as another example of the direction reverse to the first direction). The cover 56 may be snapped on the cam follower 55, bonded to the cam follower 55 with an adhesive, or integrally molded with the cam follower 55. The cover 56 includes a portion including a lower surface 56*a* and located in the groove 61. That is, the portion including the lower surface 56*a* is located below upper ends of the respective side wall surfaces 62*a*, 63*a*. In other words, the cover 56 includes the portion including the lower surface 56*a* and located closer to the cam surface than distal ends of the respective side wall surfaces 62*a*, 63*a*. Here, the length W1 of the cover 56 is slightly less than the distance W2 between the side wall surface 62*a* and the side wall surface 63*a* in the radial direction of the rotating cam 60 which is one example of a second direction. In other words, the length of the cover 56 in the radial direction is slightly less than the length of the bottom surface 60*b* of the rotating cam 60 in the radial direction. Specifically, the length of the cover 56 in the radial direction is less than the length of the bottom surface 60*b* in the radial direction by such an amount that the cover 56 can prevent foreign substances from adhering to the cam surface so as to allow the lower end 55*a* of the cam follower 55 to slide upward on the inclined surface 65 in the case where a value of a current flowing to the rotating-cam motor 109 is greatest. This construction enables the cover 56 to be situated in the groove 61. The cover 56 bends along the groove 61. This construction makes the length W1 of the cover 56 as long as possible. Furthermore, even in the case where the cover 56 is extended in the rotational direction of the rotating cam 60, it is possible to prevent the cover 56 from being caught by the side wall surfaces 62*a*, 63*a* during rotation of the rotating cam 60.

The lower surface 56*a* (as another example of the facing surface) of the cover 56 is a flat surface substantially parallel with the inclined surface 65. A downstream end of the lower surface 56*a* of the cover 56 in the rotational direction of the rotating cam 60 (i.e., one of opposite ends of the lower surface 56*a* which is closer to the cam follower 55 than the other) is located above the lower end 55*a* of the cam follower 55. Regardless of the position of the rotating cam 60, an upstream end of the lower surface 56*a* of the cover 56 in the rotational direction of the rotating cam 60 (i.e., one of the opposite ends of the lower surface 56*a* which is farther from the cam follower 55 than the other) is higher in position than an upper end of the inclined surface 65, i.e., an upstream end of the inclined surface 65 in the rotational direction of the rotating cam 60. Thus, regardless of the position of the rotating cam 60, the end of the lower surface 56*a* of the cover 56 which is farther from the cam follower 55 is farther from the lower end 55*a* of the cam follower 55 than the upper end of the inclined surface 65 in the vertical direction. The length L3 of the lower surface 56*a* of the cover 56 in the rotational direction of the rotating cam 60 is slightly greater than the length L4 of the inclined surface 65 in the rotational direction of the rotating cam 60. More specifically, the length L3 of the lower surface 56*a* of the cover 56 is substantially equal in the rotational direction of the rotating cam 60 to the sum of the length L4 of the inclined surface 65 and an error of a stop position of the rotating cam 60. Here, the stop position of the rotating cam 60 in a state in which the cover 56 faces and covers the inclined surface 65 (the state in FIG. 4A) as will be described below is set and stored in the ROM 102 (see FIG. 7) of the controller 100 which will be described below. The error of the stop position of the rotating cam 60 is an error that is allowed for the set stop position and corresponds to positional displacement of the rotating cam 60 in its rotational direction. This error is caused by an error of a stop position of the rotating-cam motor 109 and/or a backlash between gears connecting the rotating cam 60 and the rotating-cam motor 109 to each other, for example.

Figure 4A:
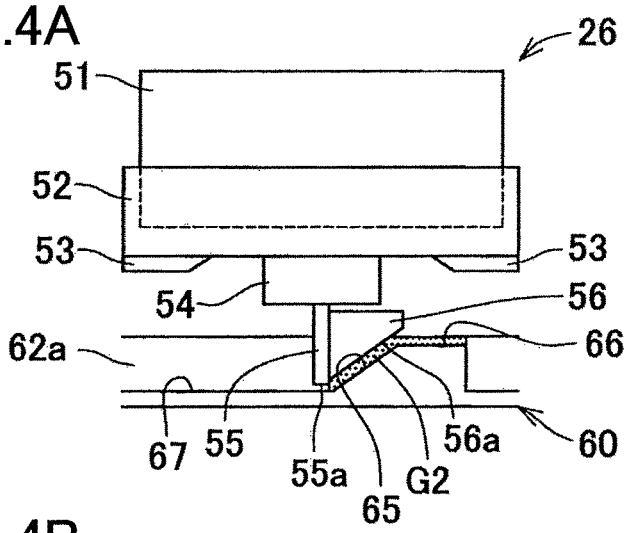

In a standby state of the wiper 26 in which the wiper 26 does not wipe ink off the nozzle surface 3*a*, as illustrated in FIGS. 4A and 5A, the lower end 55*a* of the cam follower 55 is located at a predetermined position on the parallel surface 67 which is located just downstream (for example, at a distance of 1-2 mm) of the inclined surface 65 in the rotational direction of the rotating cam 60. In this state, the lower end portions of the respective protrusions 53 of the wiper holder 52 are supported on the support surface 71, and the lower end 55*a* of the cam follower 55 is located above and spaced apart from the parallel surface 67. Thus, even when the rotating cam 60 is rotated in the state in which the lower end 55*a* of the cam follower 55 is opposed to the parallel surface 67, the lower end 55*a* of the cam follower 55 is not slid on the parallel surface 67. It should be understood that the present disclosure is not limited to this construction, and this printer 1 may be configured such that the lower end 55*a* of the cam follower 55 is in contact with the parallel surface 67 in a state in which the lower end 55*a* is opposed to the parallel surface 67, and when the rotating cam 60 is rotated, the lower end 55*a* is slid on the parallel surface 67. In the standby state, the wiper holder 52 is pressed against the side wall surface 73 by the urging force of the spring 75.

In the standby state of the wiper 26, the cover 56 faces and covers the inclined surface 65. In the present embodiment, as described above, the length L3 of the lower surface 56*a* of the cover 56 in the rotational direction of the rotating cam 60 is slightly greater than the length L4 of the inclined surface 65 in the rotational direction of the rotating cam 60 and substantially equal to the sum of the length L4 of the inclined surface 65 and the error of the stop position of the rotating cam 60 in the rotational direction of the rotating cam 60. Accordingly, the entire inclined surface 65 is covered with the cover 56 in the standby state of the wiper 26, thereby preventing foreign substances from adhering to the inclined surface 65 in the standby state of the wiper 26. Furthermore, since the length L3 of the lower surface 56*a* of the cover 56 is substantially equal in the rotational direction of the rotating cam 60 to the sum of the length L4 of the inclined surface 65 and the error of the stop position of the rotating cam 60, the cover 56 reliably covers the entire length of the inclined surface 65 in the rotational direction without making the length L3 in the rotational direction of the rotating cam 60 unnecessarily long. In the present embodiment, since the cover 56 is provided on the cam follower 55, there is no space between the cam follower 55 and the cover 56, making it possible for the cover 56 to reliably cover the inclined surface 65.

In the present embodiment, since the cover 56 includes the portion including the lower surface 56*a* and located in the groove 61, the lower surface 56*a* of the cover 56 is located near the inclined surface 65 when compared with a case where the entire cover 56 is located above the groove 61 (above the side walls 62, 63). Accordingly, covering the inclined surface 65 with the cover 56 more effectively prevents foreign substances from adhering to the inclined surface 65.

Without the cover 56, since the upper surface 60*a* of the rotating cam 60 has the inclined surface 65 facing obliquely upward, foreign substances may easily adhere to the inclined surface 65. Accordingly, covering the inclined surface 65 with the cover 36 is effective to prevent foreign substances from adhering to the inclined surface 65 as described above.

The lower surface 56*a* of the cover 56 is flat and substantially parallel with the inclined surface 65. Also, the opposite ends of the lower surface 56*a* of the cover 56 which are respectively closer to and farther from the cam follower 55 are located as described above. In the standby state of the wiper 26, accordingly, a gap of about 0.5 mm is formed between the cover 56 and the inclined surface 65. This gap is filled with the grease G2. This construction prevents ingress of foreign substances into the gap in the state in which the inclined surface 65 is covered with the cover 56.

In the present embodiment, since the cover 56 is provided on the cam follower 55, it is difficult for foreign substances to enter a gap formed between the lower end 55*a* of the cam follower 55 and the parallel surface 67 from an upstream side in the rotational direction of the rotating cam 60 in the standby state of the wiper 26.

Figure 4B:
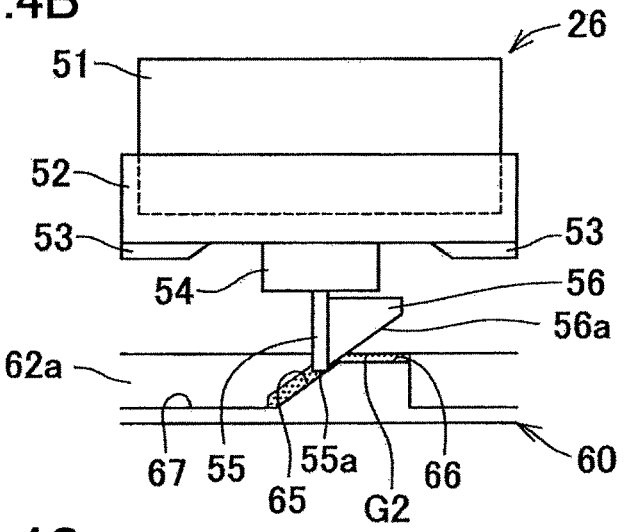
Figure 4C:
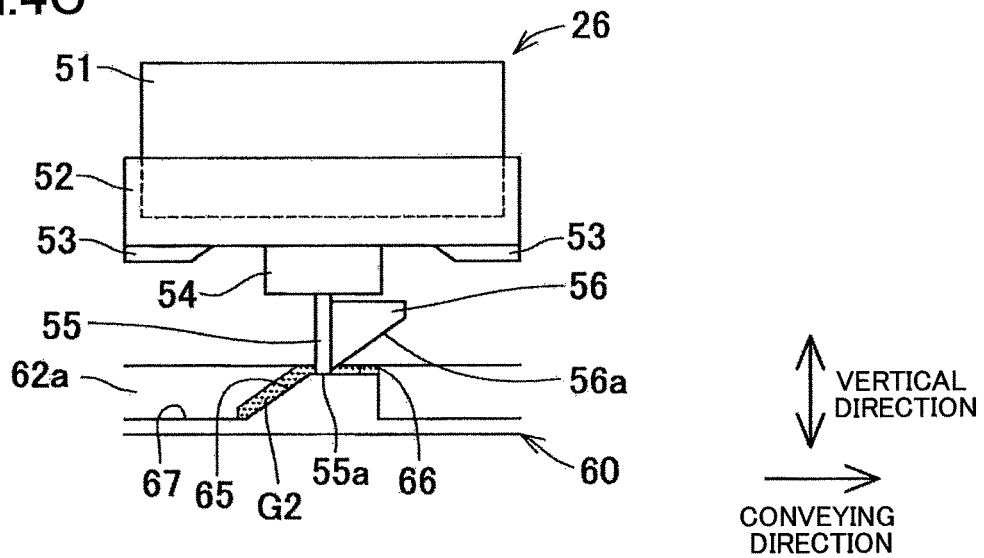

When the rotating cam 60 is rotated by the rotating-cam motor 109 in this state, the groove 61 and the cam follower 55 are moved relatively to each other. With this movement, as illustrated in FIGS. 4B and 4C, the lower end 55*a* of the cam follower 55 is slid on the inclined surface 65 and the parallel surface 66 in this order. In this sliding, the grease G2 provided between the lower end 55*a* of the cam follower 55 and each of the inclined surface 65 and the parallel surface 66 enables smooth movement of the lower end 55*a* of the cam follower 55 and each of the inclined surface 65 and the parallel surface 66. When the lower end 55*a* of the cam follower 55 is slid on the inclined surface 65, the cam follower 55 is moved upward. This movement moves the wiper 26 upward. In other words, the wiper 26 is moved in the intersecting direction. In this movement, the cover 56 provided on the cam follower 55 is also moved upward together with the cam follower 55. In the present embodiment, the upward movement of the cam follower 55 is another example of the movement for transmission of power to the driven member.

In this movement, when a left surface of the wiper holder 52 is slid on the side wall surface 73, and the rotating cam 60 is rotated until the lower end 55*a* of the cam follower 55 is slid on the parallel surface 66, as illustrated in FIG. 5C, the wiper holder 52 is moved leftward by the urging force of the spring 75 after the wiper 26 is moved upward until the protrusions 53 are moved to positions above the support surface 72. As a result, the protrusions 53 are moved to positions at which the protrusions 53 are supported on the support surface 72. In this state, the left surface of the wiper holder 52 is held in contact with the side wall surface 74, and the wiper holder 52 is pressed against the side wall surface 74 by the urging force of the spring 75.

The lower end 55*a* of the cam follower 55 is moved upward by being slid on the inclined surface 65, gravity and a frictional force between the cam follower 55 and the inclined surface 65 act on the cam follower 55. These forces act in a direction from a downstream side toward an upstream side of the inclined surface 65 in the conveying direction. When the cam follower 55 is moved upward, the cam follower 55 is moved against these forces, whereby a relatively large load is exerted on the rotating-cam motor 109. Thus, in case where foreign substances adhere to the inclined surface 65 in the standby state of the wiper 26, foreign substances may thereafter enter a space between the cam follower 55 and the inclined surface 65 when the rotating cam 60 is rotated. If foreign substances enter the gap between the cam follower 55 and the inclined surface 65, when the cam follower 55 and the inclined surface 65 are slid, the foreign substances may be caught between the cam follower 55 and the inclined surface 65 and interfere with their sliding, which may impose an excessive load on the rotating-cam motor 109. In the present embodiment, in contrast, the inclined surface 65 is covered with the cover 56 in the standby state of the wiper 26 as described above. This configuration prevents foreign substances from adhering to the inclined surface 65 in the standby state of the wiper 26 before upward movement of the wiper 26. As a result, when the lower end 55*a* of the cam follower 55 is slid upward on the inclined surface 65, this sliding is not hindered by foreign substances caught between the lower end 55*a* and the inclined surface 65, making it possible to prevent an excessive load from acting on the rotating-cam motor 109.

In the present embodiment, a load imposed on the rotating-cam motor 109 increases when the lower end 55*a* of the cam follower 55 is slid upward on the inclined surface 65, but the cover 56 provided on the cam follower 55 is shaped so as to have only a portion corresponding to the inclined surface 65 and not to have a portion that corresponds to a portion of the bottom surface 60*b* of the groove 61, which portion differs from the inclined surface 65. That is, the cover 56 has a rational shape that enables the cover 56 to cover the inclined surface 65 which is highly required to be covered among the bottom surface 60*b* of the groove 61.

Here, from the viewpoint of preventing foreign substances from adhering to the inclined surface 65, the cover 56 and the inclined surface 65 are preferably in contact with each other with no gap therebetween in the state in which the inclined surface 65 is covered with the cover 56. In this case, however, when the lower end 55*a* of the cam follower 55 and the inclined surface 65 are slid, the lower surface 56*a* of the cover 56 and the inclined surface 65 are also slid, leading to a larger load on the rotating-cam motor 109. In the present embodiment, in contrast, the gap is formed between the cover 56 and the inclined surface 65 in the state in which the lower surface 56*a* of the cover 56 faces the inclined surface 65. This gap prevents sliding of the lower surface 56*a* of the cover 56 and the inclined surface 65 when the lower end 55*a* of the cam follower 55 is slid on the inclined surface 65, resulting in reduced load on the rotating-cam motor 109.

Figure 6A:
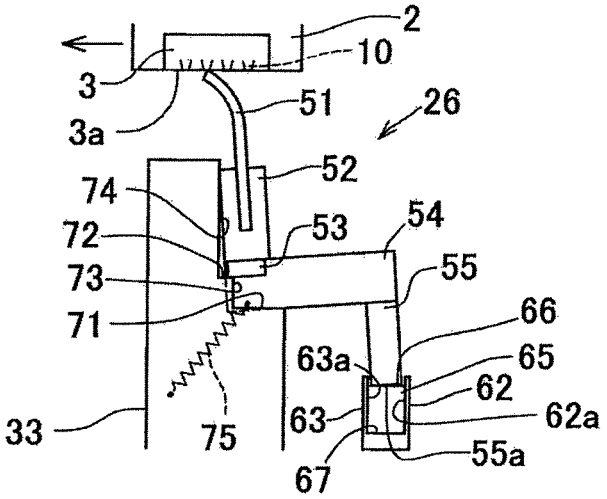
FIG. 6A is a view illustrating a state in which the carriage is moved leftward to wipe ink off a nozzle surface with a wiper rubber.

When the carriage 2 is moved leftward from the maintenance position in the state in which the wiper 26 is located at its high position, as illustrated in FIG. 6A, the carriage 2 is moved leftward in a state in which an upper end portion of the wiper rubber 51 is in contact with the nozzle surface 3*a*, so that the wiper rubber 51 wipes the ink off the nozzle surface 3*a*. A leftward force is applied from the carriage 2 to the wiper 26 in this wiping, but the wiper holder 52 is not moved in the scanning direction though being pressed against the side wall surface 74, that is, the wiper holder 52 is kept supported by the support surface 72.

Figure 6B:
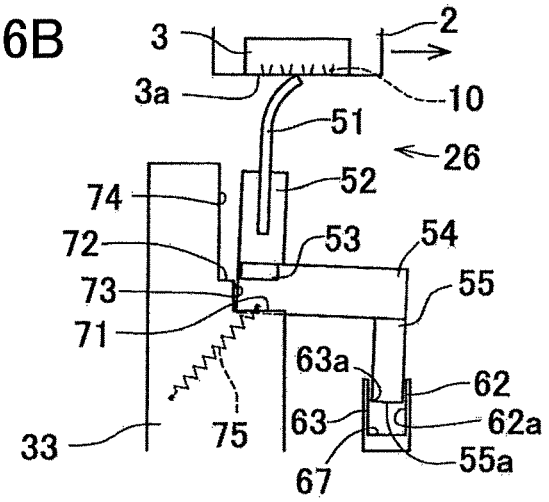
FIG. 6B is a view illustrating a state in which the carriage is moved rightward to drop the wiper.

When the carriage 2 is thereafter moved rightward, as illustrated in FIG. 6B, the carriage 2 is moved rightward in the state in which the upper end portion of the wiper rubber 51 is in contact with the nozzle surface 3*a*. In this movement, a rightward force is applied from the carriage 2 to the wiper 26. This force moves the wiper 26 so as to move the protrusions 53 to positions located to the right of the support surface 72. As a result, the wiper 26 falls, due to gravity and the urging force of the spring 75, to a position (indicated at FIG. 5A) at which the protrusions 53 are supported on the support surface 71.

Figure 6C:
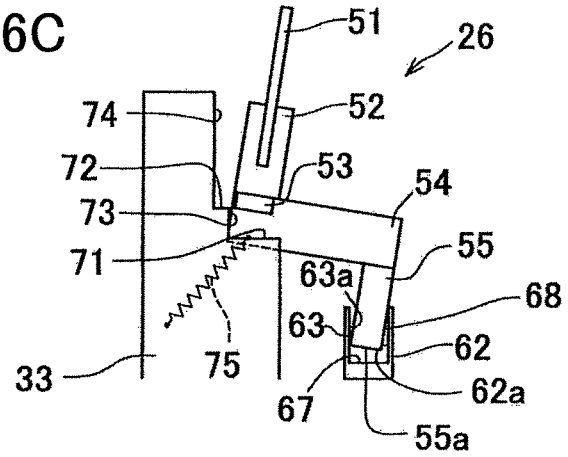
FIG. 6C is a view for explaining a drop of the wiper due to a cam follower being located in a protrusion of a groove.
Figure 6C:
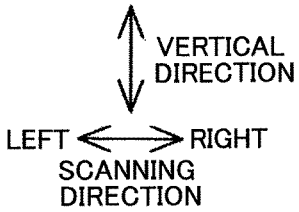

Even in the case where the rightward force applied from the carriage 2 to the wiper 26 is not large enough to drop the wiper 26, when the rotating cam 60 is rotated until the cam follower 55 is moved into the protrusion 68, the wiper 26 falls to the position at which the protrusions 53 are supported on the support surface 71. More specifically, as illustrated in FIG. 6C, when the rotating cam is rotated until the cam follower 55 is located in the protrusion 68, the cam follower 55 is moved leftward in the scanning direction, in other words, the cam follower 55 is moved outward in the radial direction of the rotating cam 60. This movement inclines the wiper 26 and moves the protrusions 53 to the positions located to the right of the support surface 72. As a result, as in the above-described case, the wiper 26 falls to the position (indicated at FIG. 5A) at which the protrusions 53 are supported on the support surface 71.

In the present embodiment, as described above, it is difficult for foreign substances to enter the space formed between the lower end 55*a* of the cam follower 55 and the parallel surface 67 in the standby state of the wiper 26. Accordingly, in the case where the lower end 55*a* of the cam follower 55 and the parallel surface 67 are slid when the rotating cam 60 is rotated, it is possible for the lower end 55*a* of the cam follower 55 and the parallel surface 67 to be slid without being hindered by foreign substances caught therebetween as described above.

Controller

Figure 7:
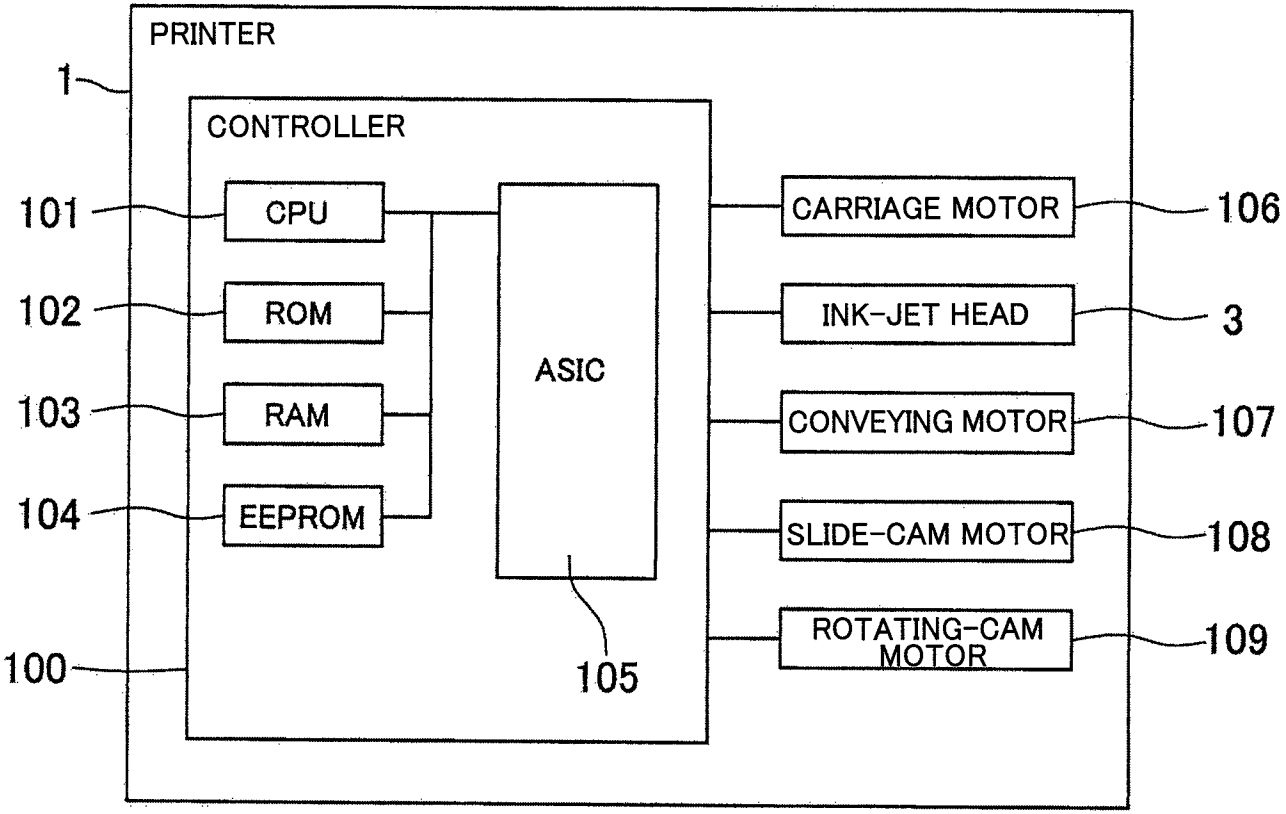
FIG. 7 is a block diagram illustrating an electric configuration of the printer.

There will be next explained the controller 100. As illustrated in FIG. 7, the controller 100 includes a central processing unit (CPU) 101, the ROM 102, a random access memory (RAM) 103, an electrically erasable programmable ROM (EEPROM) 104, and an application-specific integrated circuit (ASIC) 105. The controller 100 controls operations of the carriage motor 106, the ink-jet head 3, the conveying motor 107, the slide-cam motor 108, and the rotating-cam motor 109, for example.

While FIG. 7 illustrates the single CPU 101, the controller 100 may include the single CPU 101 that executes processings solely and may include a plurality of the CPUs 101 that share execution of the processings. Likewise, while FIG. 7 illustrates the single ASIC 105, the controller 100 may include the single ASIC 105 that executes processings solely and may include a plurality of the ASICs 105 that share execution of the processings.

In the present embodiment, a mechanism configured to transmit power from the slide-cam motor 108 to the cap 21 and the carriage lock 25 and including the slide cam 40 and the supporter 32 provided with the cam follower 35 is one example of a power transmitter. This power transmitter and the controller 100 configured to control the slide-cam motor 108, the cap 21, the carriage locker 25, and the slide-cam motor 108 are one example of each of a cap mover, a lock mover, and a power device.

In the present embodiment, a mechanism including the rotating cam 60 and the cam follower 55 and configured to transmit power from the rotating-cam motor 109 to the wiper 26 is another example of the power transmitter. This power transmitter and the controller 100 configured to control the rotating-cam motor 109, the wiper 26, and the rotating-cam motor 109 are one example of a wiper mover and another example of the power device.

There will be next explained control executed by the controller 100. In a state in which the printer 1 does not execute printing, the controller 100 controls the carriage motor 106 to move the carriage 2 to the maintenance position. The controller 100 also controls the slide-cam motor 108 such that the cam follower 35 is located on the parallel surface 42 as illustrated in FIG. 2C. As a result, in a state in which the carriage 2 is at the maintenance position, the nozzles 10 are covered with the cap 21, and the carriage lock 25 limits movement of the carriage 2 in the scanning direction.

In the case where printing is to be performed, the controller 100 controls the slide-cam motor 108 to move the slide cam 40 to a downstream side in the conveying direction, whereby as illustrated in FIG. 2A the cap 21 is moved downward away from the nozzle surface 3*a*, and the carriage lock 25 is moved downward to allow movement of the carriage 2. The controller 100 then moves the carriage 2 leftward to a position opposed to the recording sheet P. Since the inclined surface 65 is covered with the cover 36 at this time, it is possible to prevent foreign substances from adhering to the inclined surface 65 during printing.

After the completion of printing, the controller 100 controls the carriage motor 106 to move the carriage 2 to the maintenance position. The controller 100 then controls the slide-cam motor 108 to move the slide cam 40 toward an upstream side in the conveying direction, whereby the cap 21 is moved upward so as to be brought into close contact with the nozzle surface 3*a*, and the carriage lock 25 is moved upward so as to be inserted into the recess 2*a*.

In the standby state of the wiper 26 in which the wiper 26 does not wipe ink off the nozzle surface 3*a*, as illustrated in FIG. 4A, the controller 100 controls the rotating-cam motor 109 such that the lower end 55*a* of the cam follower 55 is positioned at the predetermined position on the parallel surface 67 such that the lower surface 56*a* of the cover 56 faces the inclined surface 65. The predetermined position is located just downstream of the inclined surface 65 in the rotational direction of the rotating cam 60. As a result, the entire length of the inclined surface 65 in the rotational direction is covered with the cover 56 in the standby state of the wiper 26 as described above.

When the wiper 26 wipes the ink off the nozzle surface 3*a* after, e.g., the suction purging, the controller 100 controls the slide-cam motor 108 to move the slide cam 40 toward a downstream side in the conveying direction to move the cap 21 and the carriage lock 25 downward. The controller 100 controls the rotating-cam motor 109 to rotate the rotating cam 60 to move the wiper 26 upward.

The controller 100 controls the carriage motor 106 to move the carriage 2 leftward in the state in which the wiper 26 is located at its high position, whereby the wiper rubber 51 wipes the ink off the nozzle surface 3*a*. The controller 100 then controls the carriage motor 106 to move the carriage 2 rightward to the maintenance position. The controller 100 then controls the slide-cam motor 108 to move the slide cam 40 toward an upstream side in the conveying direction to move the cap 21 and the carriage lock 25 upward. In parallel with this control, the controller 100 controls the rotating-cam motor 109 to rotate the rotating cam 60 to a position corresponding to the standby state of the wiper 26. As a result, the wiper 26 falls when the carriage 2 is moved rightward to the maintenance position as described above or when the cam follower 55 is located in the protrusion 68 during rotation of the rotating cam 60 to its position corresponding to the standby state of the wiper 26.

While the embodiment has been described above, it is to be understood that the disclosure is not limited to the details of the illustrated embodiment, but may be embodied with various changes and modifications, which may occur to those skilled in the art, without departing from the spirit and scope of the disclosure.

Figure 8A:
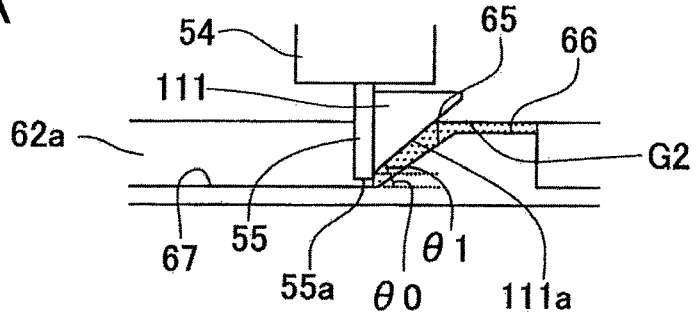
FIG. 8A is a view illustrating a relationship between a cover and the inclined surface in a first modification.
Figure 8B:
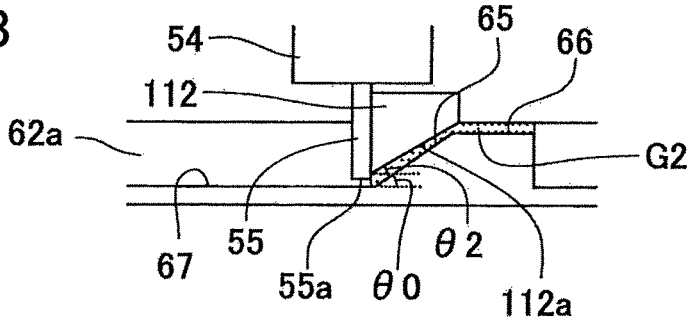
FIG. 8B is a view illustrating a relationship between a cover and the inclined surface in a second modification.

In the above-described embodiment, the lower surface 56*a* of the cover 56 is a flat surface parallel with the inclined surface 65, but the present disclosure is not limited to this configuration. In a first modification, for example, as illustrated in FIG. 8A, the angle θ1 of inclination of a lower surface 111*a* of a cover 111 provided on the cam follower 55 with respect to the rotational direction of the rotating cam 60 is greater than the angle θ0 of inclination of the inclined surface 65 with respect to the rotational direction of the rotating cam 60. In a second modification, as illustrated in FIG. 8B, the angle θ2 of inclination of a lower surface 112*a* of a cover 112 provided on the cam follower 55 with respect to the rotational direction of the rotating cam 60 is less than the angle θ0 of inclination of the inclined surface 65 with respect to the rotational direction of the rotating cam 60. In the first and second modifications, as in the above-described embodiment, one of opposite ends of each of the lower surfaces 111*a*, 112*a* which is closer to the cam follower 55 than the other is located above the lower end 55*a* of the cam follower 55. The other of the opposite ends of each of the lower surfaces 111*a*, 112*a* is located above the upper end of the inclined surface 65 (i.e., the upstream end thereof in the rotational direction of the rotating cam 60), whereby the other of the opposite ends is farther from the lower end 55*a* of the cam follower 55 than the upper end of the inclined surface 65.

Figure 8C:
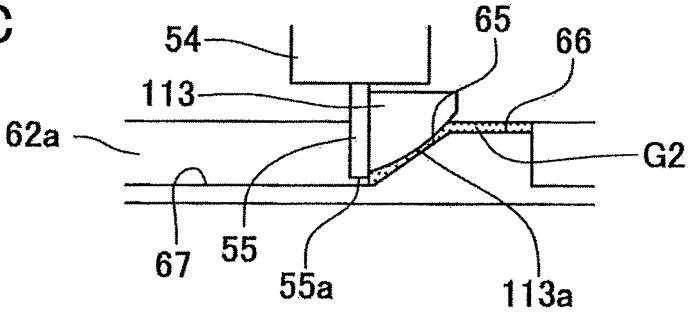
FIG. 8C is a view illustrating a relationship between a cover and the inclined surface in a third modification.
Figure 8D:
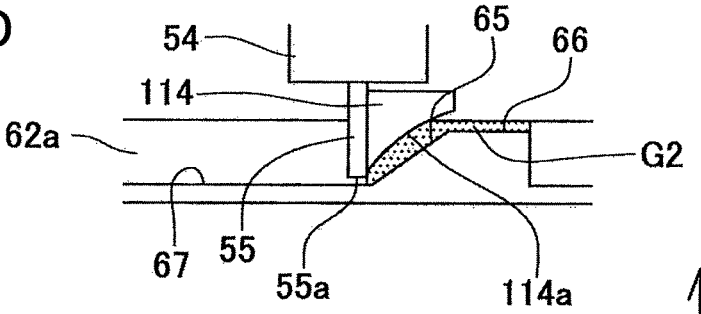
FIG. 8D is a view illustrating a relationship between a cover and the inclined surface in a fourth modification.
Figure 8D:
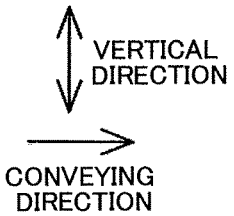

The lower surface of the cover provided on the cam follower 55 may not be flat. In a third modification, as illustrated in FIG. 8C, a lower surface 113*a* of a cover 113 provided on the cam follower 55 is curved so as to protrude toward the inclined surface 44. In a fourth modification, as illustrated in FIG. 8D, a lower surface 114*a* of a cover 114 provided on the cam follower 55 is curved so as to protrude away from the inclined surface 44.

Also in the first through fourth modifications, a gap is formed between the inclined surface 65 and each of the covers 111-114 without contact of each cover with the inclined surface 65 in a state in which each cover faces and covers the inclined surface 65.

As in the modification described above, the lower surface 36*a* of the cover 36 provided on the cam follower 35 may differ from a flat surface parallel with the inclined surface 44 of the slide cam 40. For example, the lower surface of the cover provided on the cam follower 35 may be a flat surface, of which angle of inclination with respect to the conveying direction is greater or less than the angle of inclination of the inclined surface 44 with respect to the conveying direction. Alternatively, the lower surface of the cover provided on the cam follower 35 may be curved so as to protrude toward or away from the inclined surface 44.

In the above-described embodiment, the gap is formed between the cover 56 and the inclined surface 65 without contact therebetween in the state in which the cover 56 faces and covers the inclined surface 65, but the present disclosure is not limited to this configuration. For example, the printer 1 may be configured such that the inclined surface 65 and the lower surface of the cover provided on the cam follower 55 are parallel with each other and such that the lower surface of the cover is in contact with the inclined surface 65 in the state in which the cover faces and covers the inclined surface 65. In this configuration, there is no gap between the cover and the inclined surface 65 in the state in which the cover faces and covers the inclined surface 65, making it difficult for foreign substances to adhere to the inclined surface 65. In this configuration, however, when the lower end 55*a* of the cam follower 55 is slid on the inclined surface 65, the lower surface of the cover is also slid on the inclined surface 65, resulting in a heavier load on the rotating-cam motor 109.

Even in the case where the lower surface of the cover provided on the cam follower 55 is not parallel with the inclined surface 65, the lower surface of the cover may be in contact with the inclined surface 65 in the state in which the cover faces and covers the inclined surface 65 as in the above-described first through fourth modifications. In this configuration, only a portion of the lower surface of the cover is in contact with the inclined surface 65.

Likewise, the lower surface of the cover provided on the cam follower 35 may be in contact with the inclined surface 44 in a state in which the cover covers the inclined surface 44 of the slide cam 40.

While the cover 56 provided on the cam follower 55 is curved along the groove 61 of the rotating cam 60 in the above-described embodiment, the present disclosure is not limited to this configuration. The cover provided on the cam follower 55 may extend linearly from the cam follower 55. In this configuration, however, the length of the cover in each of the radial direction of the rotating cam 60 and a direction tangent to the groove 61 needs to be made such a length that the cover is not caught by the side wall surfaces 62*a*, 63*a* when the rotating cam 60 is rotated.

While the portion of the cover 56 provided on the cam follower 55 which includes the lower surface 56*a* is located in the groove 61 in the above-described embodiment, the present disclosure is not limited to this configuration. The entire cover provided on the cam follower 55 may be located above the groove 61 (i.e., the side walls 62, 63). In this configuration, when compared with the above-described embodiment, the cover is further from the bottom surface 60*b* of the groove 61, thereby less effectively preventing foreign substances from adhering to the inclined surface. However, since the cover is not caught by the side wall surfaces 62*a*, 63*a* when the rotating cam 60 is rotated, the freedom in shape of the cover is increased when compared with the above-described embodiment.

While the wiper 26 is moved downward by falling in the above-described embodiment, the present disclosure is not limited to this configuration. For example, the bottom surface 60*b* of the groove 61 may further have an inclined surface located upstream of the parallel surface 66 in the rotational direction of the rotating cam 60 and inclined so as to be lower at an upstream portion of the inclined surface in the rotational direction of the rotating cam 60 than at a downstream portion of the inclined surface in the rotational direction of the rotating cam 60. In this configuration, the wiper 26 may be moved downward by downward movement of the cam follower 55 which is caused by sliding of the inclined surface and the lower end 55*a* of the cam follower 55.

While the cam surface 41 of the slide cam 40 and the bottom surface 60*b* of the groove 61 of the rotating cam 60 face upward in the above-described embodiment, the present disclosure is not limited to this configuration. The cam surfaces of the slide cam and the rotating cam may face downward or in a direction orthogonal to the vertical direction. In this configuration, the printer 1 may be configured such that the cam surface has: a parallel surface parallel with a direction of movement of the cam; and an inclined surface continued to an upstream end of the parallel surface in the direction of movement of the cam and inclined with respect to the parallel surface, and such that the cam follower is provided with a cover corresponding to the inclined surface and having a length greater than that of the inclined surface in the direction of movement of the cam.

While the slide cam 40 is moved in the conveying direction in the above-described embodiment, the slide cam may be moved in a direction different from the conveying direction such as the scanning direction. While the rotating cam 60 is rotated about an axis extending in the vertical direction in the above-described embodiment, the rotating cam may be rotated about an axis extending in the scanning direction and the conveying direction.

In the above-described embodiment, the parallel surfaces 42, 43 and the inclined surface 44 of the slide cam 40 is coated with the grease G1, and the inclined surface 65 and the parallel surface 66 of the rotating cam 60 is coated with the grease G2. These surfaces may not be coated with the grease G1, G2.

In the above-described embodiment, the length L1 of the lower surface 36*a* of the cover 36 is substantially equal to the sum of the length L2 of the inclined surface 44 and the error of the stop position of the slide cam 40, and the length L3 of the lower surface 56*a* of the cover 56 is substantially equal to the sum of the length L4 of the inclined surface 65 and the error of the stop position of the rotating cam 60, but the present disclosure is not limited to this configuration. Each of the lengths L1, L3 of the lower surfaces 36*a*, 56*a* of the respective covers 36, 56 may be greater than or less than the above-described length.

In the case where each of the lengths L1, L3 of the lower surfaces 36*a*, 56*a* of the respective covers 36, 56 is greater than the above-described length, each of the covers 36, 56 is longer than necessary but capable of covering the entire length of a corresponding one of the inclined surfaces 44, 65. Even in the case where each of the lengths L1, L3 is less than the above-described length, when the error of the stop position of each of the cams 40, 60 is sufficiently small when compared with the corresponding one of the lengths L2, L4 of the respective inclined surfaces 44, 65, each of the covers 36, 56 covers substantially the entire length of the corresponding one of the inclined surfaces 44, 65 by making each of the lengths L1, L3 of the lower surfaces 36*a*, 56*a* of the respective covers 36, 56 greater than or equal to the corresponding one of the lengths L2, L4 of the respective inclined surfaces 44, 65.

In the above-described embodiment, the length L1 of the lower surface 36*a* of the cover 36 is greater than the length L2 of the inclined surface 44, and the length L3 of the lower surface 56*a* of the cover 56 is greater than the length L4 of the inclined surface 65, but the present disclosure is not limited to this configuration. The length L1 of the lower surface 36*a* of the cover 36 may be less than or equal to the length L2 of the inclined surface 44, and the length L3 of the lower surface 56*a* of the cover 56 may be less than or equal to the length L4 of the inclined surface 65. It is noted that in the case where the length L1 of the lower surface 36*a* of the cover 36 is less than the length L2 of the inclined surface 44, the cover 36 covers only a portion of the inclined surface 44. Likewise, the length L3 of the lower surface 56*a* of the cover 56 is less than the length L4 of the inclined surface 65, the cover 56 covers only a portion of the inclined surface 65.

While the cover 56 has only the portion corresponding to the inclined surface 65 of the rotating cam 60 in the above-described embodiment, the present disclosure is not limited to this configuration. For example, the cover provided on the cam follower 55 may extend over the entire perimeter of the groove 61. While the cover 36 has only the portion corresponding to the inclined surface 44 of the cam surface 41 in the above-described embodiment, the present disclosure is not limited to this configuration. For example, the cover provided on the cam follower 35 may further have portions corresponding to the respective parallel surfaces 42, 43.

In the above-described embodiment, the slide cam 40 is moved in the conveying direction to move the cap 21 and the carriage lock 25 upward and downward, and the rotating cam 60 is rotated to move the wiper 26 upward and downward, but the present disclosure is not limited to this configuration. For example, movement of the slide cam may move the wiper 26 upward and downward. Also, rotation of the rotating cam may move the cap 21 and the carriage lock 25 upward and downward.

While the cap 21 and the carriage lock 25 are moved upward and downward as a unit in the above-described embodiment, the present disclosure is not limited to this configuration. For example, the printer 1 may be configured such that the cam and the cam follower are provided for each of the cap 21 and the carriage lock 25, and the cap 21 and the carriage lock 25 are independently movable upward and downward.

In the above-described embodiment, the cover 36 is provided on the cam follower 35, whereby the cover 36 is moved upward and downward together with the cam follower 35 that is moved upward and downward by sliding on the inclined surface 44. Also, the cover 56 is provided on the cam follower 55, whereby the cover 56 is moved upward and downward together with the cam follower 55 that is moved upward and downward by sliding on the inclined surface 65. However, the present disclosure is not limited to these configurations. For example, the cover may be provided on any of the protrusion 34 and the supporter 32 to move the cover upward and downward together with the cam follower 35 that is moved upward and downward by sliding on the inclined surface 44. Also, for example, the cover may be provided on the arm 54 of the wiper holder 52 to move the cover upward and downward together with the cam follower 55 that is moved upward and downward by sliding on the inclined surface 65.

In the description provided above, the present disclosure is applied to upward and downward movement of the cap, the carriage lock, and the wiper in the printer. However, the present disclosure is not limited to this application. The present disclosure is applicable to a device for moving another component in the printer. In this case, the cam surface may not have: a surface (such as the parallel surfaces 42, 43, 66, 67) parallel with the direction of movement of the cam; and an inclined surface (such as the inclined surfaces 44, 65) inclined with respect to this surface, like the slide cam 40 and the rotating cam 60. This printer 1 may be configured such that the cam surface has another shape formed in accordance with a positional relationship between the drive source and the driven member and a way of moving the driven member and such that the cam follower is provided with a cover having a shape formed in accordance with the shape of the cam surface.

In the description provided above, the present disclosure is applied to the printer including the ink-jet head configured to eject the ink from the nozzles. However, the present disclosure is not limited to this application. For example, the present disclosure is applicable to a liquid ejection apparatus configured to eject liquid other than the ink, such as a material of a wiring pattern for a circuit board. Furthermore, the present disclosure is applicable to apparatuses and devices other than the liquid ejection apparatus.

What is claimed is:

1. A liquid ejection apparatus, comprising:

a liquid ejection head comprising a nozzle surface having a plurality of nozzles;

a carriage supporting the liquid ejection head and movable in a scanning direction parallel with the nozzle surface;

a maintenance unit configured to maintain the liquid ejection head operable, the maintenance unit comprising a maintenance member movable between a lower position and an upper position at which the maintenance member interacts with one of the liquid ejection head and the carriage; and a maintenance member mover configured to move the maintenance member in a vertical direction between the lower position and the upper position, wherein the maintenance member mover comprises:

a drive source; and a power transmitter configured to transmit power from the drive source to the maintenance member, wherein the power transmitter comprises:

a cam connected to the drive source and movable in a first direction, the cam comprising a cam surface which includes a first flat surface, a second flat surface which is above the first flat surface and upstream of the first flat surface in the first direction, and an inclined surface between the first flat surface and the second flat surface in the first direction, the first flat surface and the second flat surface facing upward and extending parallel with the first direction, and the inclined surface facing upward and being inclined relative to the first direction;

a cam follower connected to the maintenance member, the cam follower comprising a sliding portion slidable on the cam surface; and a dust cover extending from the cam follower and including a facing surface which faces downward, the dust cover being configured to reduce adhesion of dust onto the cam surface, wherein when the cam moves in the first direction, the sliding portion slides from a first position at which a lower end of the sliding portion is in contact with the first flat surface to a second position at which the lower end of the sliding portion is in contact with the second flat surface, thereby moving the maintenance member from the lower position to the upper position, and wherein the dust cover is configured to move together with the cam follower when the sliding portion slides from the first position to the second position, and the facing surface of the dust cover faces the inclined surface downward and covers an entire length of the inclined surface in the first direction when the sliding portion is at the first position.

2. The liquid ejection apparatus according to claim 1, wherein the maintenance member comprises a wiper movable between the lower position and the upper position and configured to, when at the upper position, wipe liquid off the nozzle surface, and the maintenance member mover is configured to move the wiper in the vertical direction, and wherein the power transmitter of the maintenance member mover is configured to transmit power from the drive source to the wiper, and the cam follower of the power transmitter is connected to the wiper.

3. The liquid ejection apparatus according to claim 2, further comprising a controller configured to control the drive source to move the cam in the first direction, wherein in a state in which the wiper does not wipe liquid off the nozzle surface, the controller is configured to control the drive source to position the sliding portion at the first position such that the facing surface of the dust cover faces the inclined surface downward and covers the entire length of the inclined surface in the first direction.

4. The liquid ejection apparatus according to claim 1, wherein the maintenance member comprises a cap movable between the lower position and the upper position and configured to, when at the upper position, cover the plurality of nozzles, and the maintenance member mover is configured to move the cap in the vertical direction, and wherein the power transmitter of the maintenance member mover is configured to transmit power from the drive source to the cap, and the cam follower of the power transmitter is connected to the cap.

5. The liquid ejection apparatus according to claim 1, wherein the maintenance unit further comprises a cap configured to cover the plurality of nozzles, and the maintenance member comprises a carriage lock movable between the lower position and the upper position and configured to, when at the upper position, lock the carriage from moving in the scanning direction in a state in which the plurality of nozzles are covered with the cap, and the maintenance member mover is configured to move the carriage lock in the vertical direction, and wherein the power transmitter of the maintenance member mover is configured to transmit power from the drive source to the carriage lock, and the cam follower of the power transmitter is connected to the carriage lock.

6. The liquid ejection apparatus according to claim 1, wherein the first direction is a direction orthogonal to the scanning direction and the vertical direction.

7. The liquid ejection apparatus according to claim 1, wherein the facing surface of the dust cover is parallel with the inclined surface of the cam.

8. The liquid ejection apparatus according to claim 1, wherein when the sliding portion of the cam follower is at the first position, a downstream end in the first direction of the facing surface of the dust cover is located above the lower end of the sliding portion, and an upstream end in the first direction of the facing surface is located above an upstream end of the inclined surface of the cam.

9. The liquid ejection apparatus according to claim 1, wherein when the sliding portion of the cam follower is at the first position, there is a gap between the facing surface of the dust cover and the inclined surface of the cam.

10. The liquid ejection apparatus according to claim 1, wherein a length of the facing surface of the cover in a second direction orthogonal to the first direction is slightly less than a length of the cam surface in the second direction.

11. The liquid ejection apparatus according to claim 1, wherein a length of the sliding portion of the cam follower in a second direction orthogonal to the first direction is less than a length of the cam surface in the second direction.

12. The liquid ejection apparatus according to claim 1, wherein the cam is a rotating cam having a groove extending in a circumferential direction of the rotating cam, and the cam surface is a bottom surface of the groove.

* * * * *